US005720050A

United States Patent [19]

Gioli

[11] Patent Number: 5,720,050

[45] Date of Patent: Feb. 24, 1998

[54] VARIABLE-CAPACITY POCKET

[76] Inventor: Bruno Gioli, Via Martinengo Cesaresco, 29, 25128 Brescia, Italy

[21] Appl. No.: 573,796

[22] Filed: Dec. 18, 1995

[30] Foreign Application Priority Data

Dec. 21, 1994 [IT] Italy ..... BS940095 U

[51] Int. Cl.[6] ..... A41D 27/00; A41D 27/20

[52] U.S. Cl. ..... 2/247; 2/248; 2/253; 2/243.1

[58] Field of Search ..... 2/69, 69.5, 75, 2/80, 48, 49.1, 49.2, 49.3, 49.4, 49.5, 50, 51, 52, 94, 105, 106, 115, 247, 248, 249, 250, 251, 252, 253, 243.1

[56] References Cited

U.S. PATENT DOCUMENTS

| | | | |
|---|---|---|---|
| 1,787,706 | 1/1931 | Stember . | |
| 2,165,081 | 7/1939 | Wald | 2/247 |
| 2,304,574 | 12/1942 | Kirschenbaum . | |
| 2,405,964 | 8/1946 | Lauria . | |
| 2,565,023 | 8/1951 | Hepp . | |
| 4,301,549 | 11/1981 | Ingram | 2/250 |
| 4,404,689 | 9/1983 | DeWan | 2/247 |

FOREIGN PATENT DOCUMENTS

| | | |
|---|---|---|
| 1 255 929 | 6/1961 | France . |

*Primary Examiner*—Jeanette E. Chapman

*Attorney, Agent, or Firm*—Guido Modiano; Albert Josif

[57] ABSTRACT

The variable-capacity pocket comprises an external covering element adapted to be applied at a recess provided on a surface and joined, along one edge, to the surface, on the inner side thereof, by means of a border element that can extend so as to allow the movement of the covering element between a position that lies inside the recess and an external position for extraction from the recess. An internal lining is applied to the surface to the rear of the covering element, so as to form, with respect to the covering element, a cavity that can be accessed through at least one opening of the pocket.

7 Claims, 6 Drawing Sheets

VARIABLE-CAPACITY POCKET

BACKGROUND OF THE INVENTION

The present invention relates to a variable-capacity pocket to be applied to various items, such as clothes, bags, and the like.

It is known that clothes and other items are usually provided with pockets having various shapes, which are meant to contain small objects, coins, documents and the like or are used as a mere trimming.

Pockets, particularly in clothes, are generally constituted by a pouch sewn inside an appropriate opening of the item of clothing. However, external pockets applied as patches, pockets cut in the lining, and others are also in widespread use.

Depending on its shape, the pocket can have a greater or smaller capacity. However, it is evident that the capacity of a pocket is currently predefined, independently of its utilization requirements. In other words, the capacity of conventional pockets cannot be changed so as to adapt it to actual needs.

SUMMARY OF THE INVENTION

A principal aim of the present invention is to solve the mentioned problem by providing a pocket having a configuration that can be quickly modified so as to vary its capacity.

Within the scope of this aim, an object of the present invention is to provide a pocket that is simple in concept, safely reliable in operation, and versatile in use.

This aim and this object are both achieved, according to the invention, by the present variable-capacity pocket, characterized in that it comprises an external covering element adapted to be applied at a recess provided on a surface; a border element adapted to join, at the edge, said covering element to said surface, on the inner side thereof, and extendable so as to allow the movement of said covering element between a position that lies inside said recess and an external position for extraction from said recess; an internal lining applied to said surface to the rear of said covering element and adapted to form, with respect to said covering element, a cavity that can be accessed through at least one opening of the pocket.

BRIEF DESCRIPTION OF THE DRAWINGS

Further characteristics and advantages of the invention will become apparent from the following detailed description of a preferred embodiment of the variable-capacity pocket, illustrated only by way of non-limitative example in the accompanying drawings, wherein:

FIGS. 10 and 11 show the same front view of said further embodiments of the pocket, in the corresponding external position.

DESCRIPTION OF THE PREFERRED EMBODIMENTS

Figure 1:
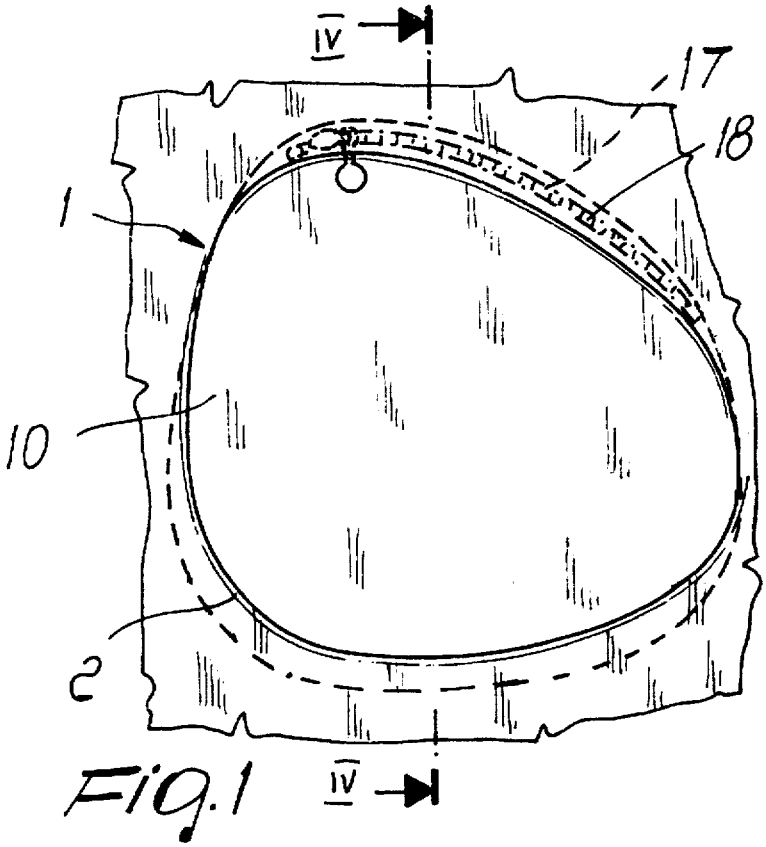
FIG. 1 is a front view of a variable-capacity pocket, in said internal position.

With particular reference to said figures, the reference numeral 1 designates the variable-capacity pocket, which is applied at a recess 2 formed on a surface 3, for example the outer fabric of an item of clothing. The recess 2 has a rounded shape.

The pocket 1 is constituted by a relatively-rigid external covering element 10; this rigidity is achieved by using an appropriate fabric or by applying an adapted reinforcement element 11 to the covering 10 on the inner side. The external covering 10 is conveniently made of the same material as the surface 3.

The external covering 10 is shaped substantially like the profile of the recess 2. Actually, the covering 10 is slightly larger than said recess 2, so as to fully close said recess 2 when, as specified hereinafter, said covering 10 is arranged in an internal position with respect to the surface 3.

The covering 10 is joined, along its edge, to the surface 3, on the inner side thereof, along the edge of the recess 2, by means of a border element 12 that forms a sort of accordion-folded part. Said accordion-folded border element 12 allows to extract the covering 10 through the recess 2, in an external position with respect to the surface 3.

Figure 3:
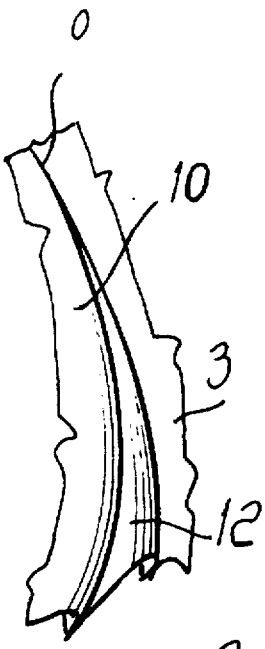
FIG. 3 is a view of a detail of said pocket, in a step in which said border element is extended.
Figure 2:
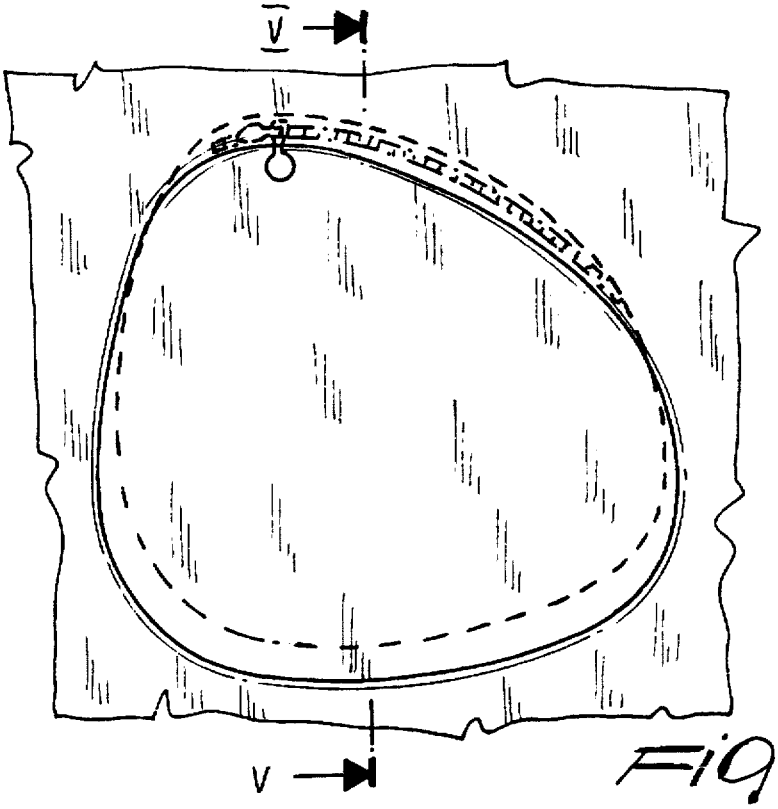
FIG. 2 is the same front view of the variable-capacity pocket in said external position.

The accordion-folded border element 12 runs along at least one portion of the perimeter of the covering 10. In the case shown in FIGS. 1 and 2, the accordion-folded border element 12 runs substantially along three sides of the covering 10 and has a profile that increases symmetrically starting from the opposite ends, at which the coupling to the covering 10 and to the surface 3 coincides in practice with a point O (see FIG. 3 for greater detail).

Figure 6:
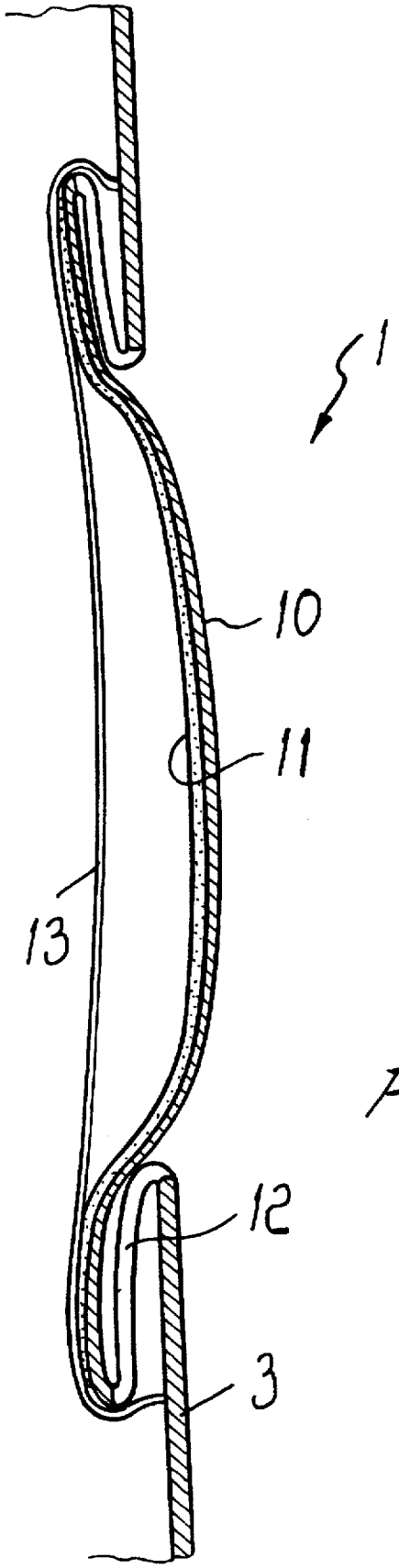
FIGS. 6 and 7 are further sectional views of the variable-capacity pocket, respectively in said internal and external positions.
Figure 7:
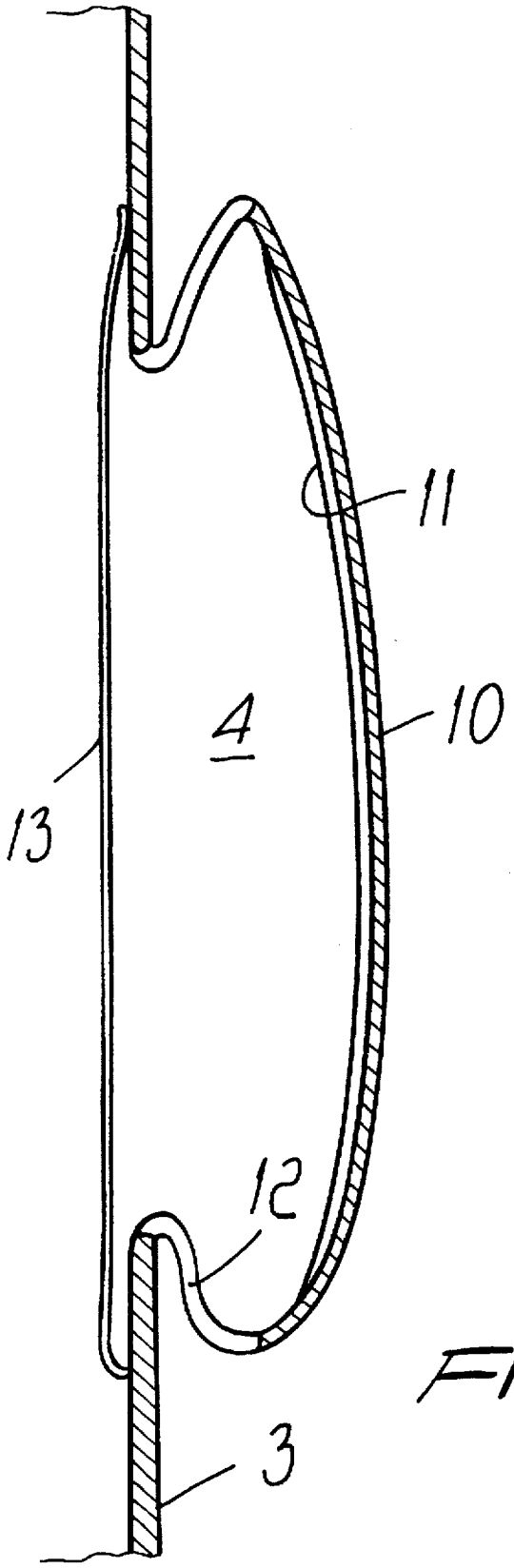

However, it is possible to provide for the accordion-folded border element 12 to run along the entire perimeter of the covering 10, as shown in FIGS. 6 and 7. In this case, of course, the covering element 10 is fully extracted from the recess 2 in said external position.

The pocket 1 is closed internally by a lining 13 applied to the surface 3, to the rear of the covering 10. The lining 13 is adapted to form, with respect to the covering 10, a cavity 4 that can be accessed through at least one opening 18 of the pocket.

Said opening 18, which is normally provided at the upper side of the pocket, can be advantageously closed by a zip fastener 17. In the case shown in FIGS. 1 and 2, the zip fastener 17 is applied in an interspace between the upper edge of the covering 10 and an inner fold of the surface 3; the zip fastener 17 is concealed below said surface 3.

Figure 8:
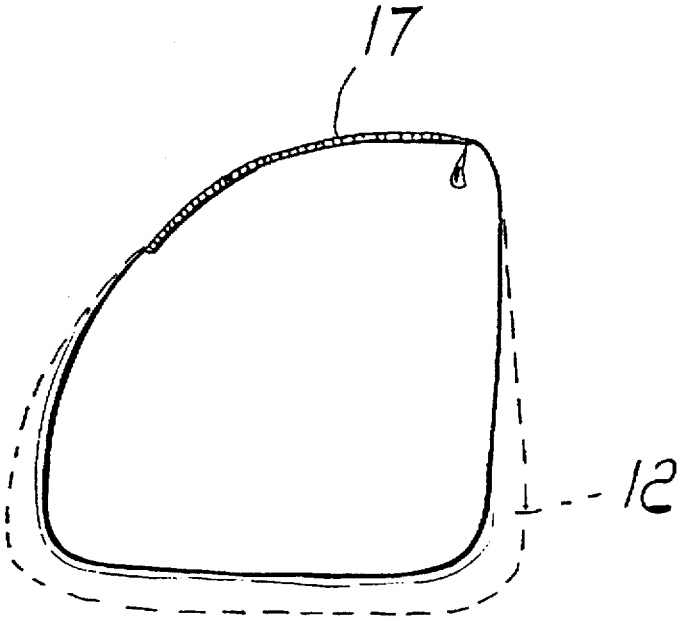
Figure 10:
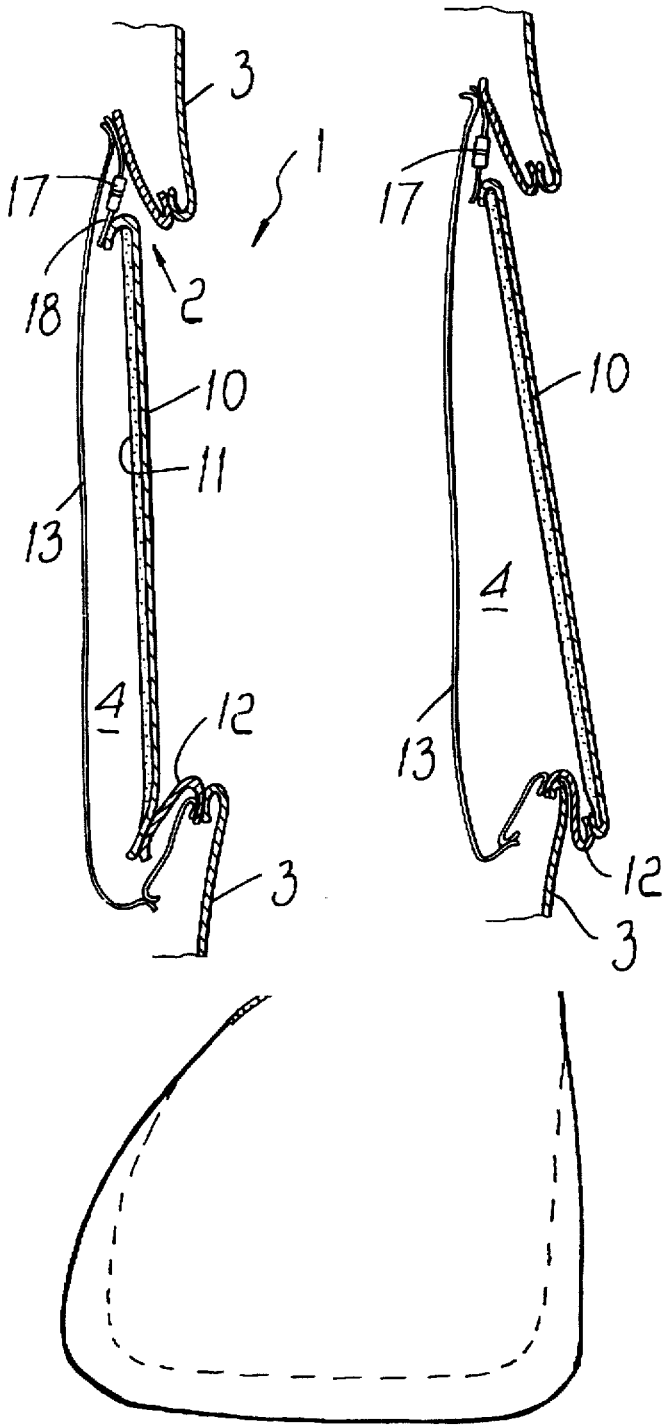

In the case shown in FIGS. 8 and 10, the zip fastener 17 is instead visible and lies along the edge of the covering 10.

Of course it is possible to provide a pocket opening that does not have closure elements. Said opening can furthermore be arranged in positions other than those described above, for example centrally to the covering 10 and not along its edge. In particular, it is possible to provide for the presence of two opposite lateral openings.

Figure 9:
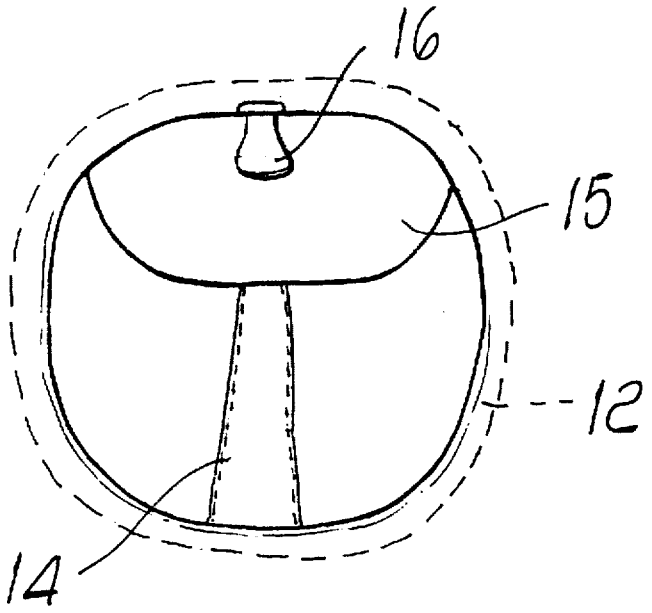
FIGS. 8 and 9 are front views of further embodiments of the pocket according to the invention, in the internal position.

The opening of the pocket can be covered with a flap 15 provided with a traction element 16, as shown in FIGS. 9 and 11. In this case, the pocket is also centrally provided with a tuck or fold 14, adapted to further increase capacity.

The operation of the variable-capacity pocket is easily understandable from the above description.

The pocket has two different operating configurations, which correspond respectively to said internal and external positions of the covering element 10.

Figure 4:
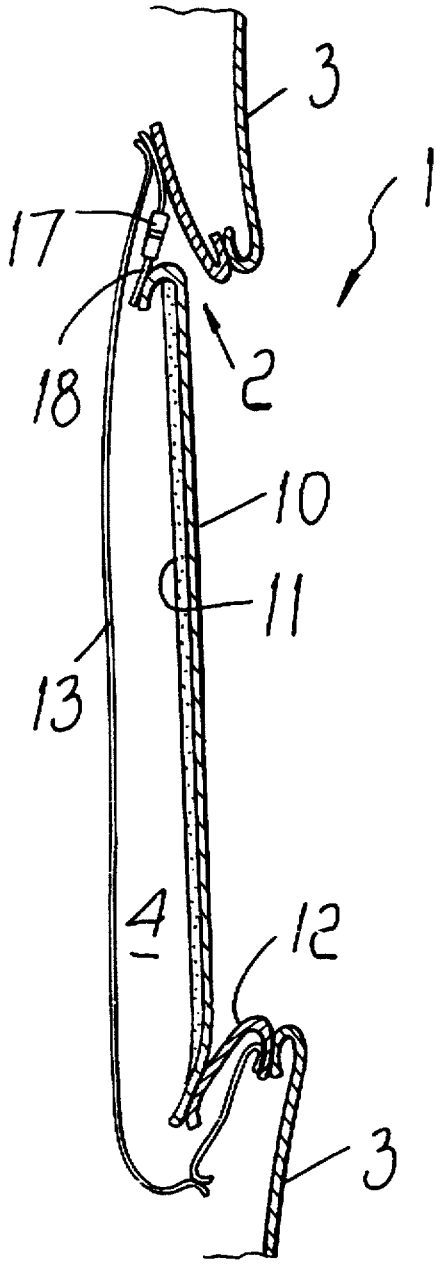
FIGS. 4 and 5 are sectional views of said variable-capacity pocket, taken respectively along the planes IV—IV and V—V of FIGS. 1 and 2.
Figure 5:
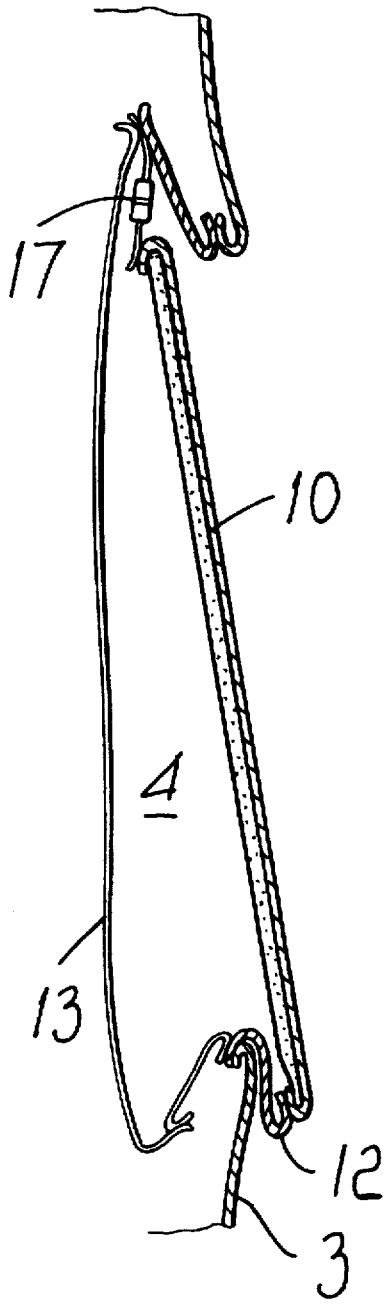

In particular, in the position that is internal to the recess 2, the covering element 10 is practically flush with the surface 3, so that the pocket has a limited capacity (see FIGS. 4 and 6). Vice versa, in the external position for extraction from said recess 2, the pocket has a significantly greater capacity, by virtue of the accordion-folded extension of the border element 12 (FIGS. 5 and 7).

In addition to a change in capacity, the transformation of the pocket also causes a modification in the aesthetic style of the item, which is significant especially in the case of items of clothing.

It should be noted that the transformation of the pocket from the internal to the external configuration is achieved in a very simple and rapid manner, with a pressure applied on the covering element 10 from the inside outwards. Said pressure causes the flexing of the covering 10 and the extraction of said covering 10 from the recess 2.

By operating in the reverse manner, of course, the transformation of the pocket from the external to the internal configuration is achieved.

In summary, the pocket according to the invention has a configuration that can be modified very quickly, so as to allow to vary its capacity according to the actual utilization requirements.

The variable-capacity pocket has a wide range of application, since it can be used not only on items of clothing but also on bags, suitcases, and other items.

In the practical embodiment of the invention, the materials employed, as well as the shapes and the dimensions, may be any according to the requirements.

What is claimed is:

1. A variable-capacity pocket, comprising: an external covering element to be applied at a recess provided on a surface of said pocket; a border element for joining, at an edge thereof, said covering element to said surface, on an inner side of said surface; said border element being extendable so as to allow movement of said covering element between an internal position that lies inside said recess and an external position for extraction from said recess; an internal lining applied to said surface to a rear region of said covering element, said lining forming, with respect to said covering element; a cavity; said cavity being accessible through at least one opening of the pocket.

2. Pocket according to claim 1, wherein said border element forms an accordion-folded part.

3. Pocket according to claim 1, further comprising a reinforcement element applied to said covering element on the inner side thereof for giving to said covering element a relative rigidity.

4. Pocket according to claim 1, wherein said covering element is slightly larger than said recess, so as to fully close said covering in said internal position.

5. Pocket according to claim 1, wherein said opening is provided along an edge portion of said covering element.

6. Pocket according to claim 1, wherein said opening is provided in an interspace between an upper edge of said covering element and an internal fold of said surface, so as to be concealed below said surface.

7. Pocket according to claim 1, wherein said border element runs along at least one portion of a perimeter line of said covering element, with a profile that expands symmetrically starting from opposite ends at which coupling to the covering element and to said surface coincides.

* * * * *